US008701308B2

(12) United States Patent
Hiroshiro et al.

(10) Patent No.: US 8,701,308 B2
(45) Date of Patent: Apr. 22, 2014

(54) FLUID HEATER, MANUFACTURING METHOD THEREOF, SUBSTRATE PROCESSING APPARATUS INCLUDING FLUID HEATER, AND SUBSTRATE PROCESSING METHOD

(75) Inventors: Koukichi Hiroshiro, Koshi (JP); Takayuki Toshima, Koshi (JP)

(73) Assignee: Tokyo Electron Limited, Minato-Ku (JP)

( * ) Notice: Subject to any disclaimer, the term of this patent is extended or adjusted under 35 U.S.C. 154(b) by 632 days.

(21) Appl. No.: 12/995,524

(22) PCT Filed: Feb. 12, 2009

(86) PCT No.: PCT/JP2009/052304

§ 371 (c)(1),
(2), (4) Date: Dec. 28, 2010

(87) PCT Pub. No.: WO2009/147871

PCT Pub. Date: Dec. 10, 2009

(65) Prior Publication Data

US 2011/0099838 A1 May 5, 2011

(30) Foreign Application Priority Data

Jun. 2, 2008 (JP) ..... 2008-144401

(51) Int. Cl.
*F26B 3/04* (2006.01)

(52) U.S. Cl.
USPC ... 34/417; 34/78; 34/80; 165/81; 165/104.17; 118/723 E; 134/135

(58) Field of Classification Search
USPC ..... 34/517, 381, 413, 417, 497, 60, 70, 77, 34/78, 80, 90; 15/3, 3.51; 165/61, 81, 165/104.11, 104.17; 118/500, 712, 723 E; 29/611; 392/489; 134/26, 135, 184, 134/198
See application file for complete search history.

(56) References Cited

U.S. PATENT DOCUMENTS 4,841,645 A * 6/1989 Bettcher et al. ..... 34/78
5,050,315 A * 9/1991 Reznik ..... 34/60

(Continued)

FOREIGN PATENT DOCUMENTS

JP 53-132035 A1 11/1978
JP 10-085879 4/1998

(Continued)

OTHER PUBLICATIONS

Japanese Office Action from a corresponding Japanese patent application bearing a mailing date of Oct. 2, 2012.

*Primary Examiner* — Steve M Gravini
(74) *Attorney, Agent, or Firm* — Burr & Brown, PLLC

(57) ABSTRACT

A fluid heater includes a duct pipe through which a fluid to be heated flows, and a heating part configured to heat the duct pipe. One or more fillers is provided inside the duct pipe. A substrate processing apparatus includes: a supply source configured to supply a liquid of a volatile organic solvent; the aforementioned fluid heater configured to heat the liquid of the organic solvent supplied by the supply source so as to generate a steam of the organic solvent; and a chamber configured to accommodate a substrate W and to dry the substrate W accommodated therein, to which the steam of the organic solvent generated by the fluid heater is supplied.

18 Claims, 4 Drawing Sheets

(56) References Cited

U.S. PATENT DOCUMENTS

| | | | | |
|---|---|---|---|---|
| 5,474,975 | A * | 12/1995 | Yamazaki | 505/433 |
| 5,956,859 | A * | 9/1999 | Matsumoto et al. | 34/74 |
| 5,987,731 | A * | 11/1999 | Yamazaki | 29/599 |
| 6,032,382 | A * | 3/2000 | Matsumoto et al. | 34/78 |
| 6,134,807 | A * | 10/2000 | Komino et al. | 34/418 |
| 8,281,498 | B2 * | 10/2012 | Nakashima et al. | 34/72 |
| 2004/0226185 | A1 * | 11/2004 | Yamaguchi et al. | 34/467 |
| 2007/0006483 | A1 * | 1/2007 | Kamikawa et al. | 34/467 |
| 2011/0099838 | A1 * | 5/2011 | Hiroshiro et al. | 34/517 |
| 2013/0104414 | A1 * | 5/2013 | Zagar | 34/274 |

FOREIGN PATENT DOCUMENTS

| | | |
|---|---|---|
| JP | 2001-038101 A1 | 2/2001 |
| JP | 2005-226942 | 8/2005 |
| JP | 2007-005479 A1 | 1/2007 |
| JP | 2007-017098 A1 | 1/2007 |
| JP | 2007-085595 | 4/2007 |
| JP | 2007-179047 A1 | 7/2007 |

* cited by examiner

FLUID HEATER, MANUFACTURING METHOD THEREOF, SUBSTRATE PROCESSING APPARATUS INCLUDING FLUID HEATER, AND SUBSTRATE PROCESSING METHOD

BACKGROUND OF THE INVENTION

1. Field of The Invention

The present invention relates to a fluid heater configured to heat a fluid, a manufacturing method thereof, a substrate processing apparatus including the fluid heater, and a substrate processing method. In particular, the present invention relates to a fluid heater capable of improving a heat transmission efficiency and a uniformity in heating a fluid flowing through a duct pipe, without machining an inner circumferential surface of the duct pipe, a manufacturing method thereof, a substrate processing apparatus including the fluid heater, and a substrate processing method.

2. Description of Related Art

Generally, in a manufacturing process by a semiconductor manufacturing apparatus, there has been widely employed a cleaning method that sequentially immerses a substrate, such as a semiconductor wafer or an LCD glass (hereinafter also referred to simply as "wafer"), into a cleaning tank storing therein a cleaning liquid such as a chemical liquid or a rinse liquid, so as to clean the substrate. In addition, there has been known a drying method that brings a steam of a volatile organic solvent, such as isopropyl alcohol (IPA), into contact with a surface of a cleaned wafer, such that the steam of the organic solvent condenses or adsorbs on the surface of the wafer, and thereafter supplies an inert gas such as $N_2$ gas (nitrogen gas) onto the surface of the wafer so as to remove and dry moisture on the surface of the wafer (see, JP2007-5479A, for example).

In the above drying method, when the steam of the organic solvent is supplied to a chamber accommodating the wafer, there is used a fluid heater that heats and vaporizes a liquid of the organic solvent, so as to generate the steam of the organic solvent. Namely, the liquid of the organic solvent is supplied from a supply source of the organic solvent to the fluid heater, the liquid of the organic solvent is heated by the fluid heater to generate the steam of the organic solvent, and the generated steam of the organic solvent is supplied to the chamber accommodating the wafer. As such a fluid heater, a heater disclosed in JP2007-17098A has been known.

The conventional fluid heater shown in JP2007-17098A includes a heat source lamp such as a halogen lamp, and a helical duct pipe disposed to surround the heat source lamp. A liquid of an organic solvent to be heated is configured to flow through the duct pipe. When a liquid of an organic solvent is made to flow through the helical duct pipe and the duct pipe is heated by the heat source lamp, the fluid flowing through the duct pipe is heated whereby a steam of the organic solvent is generated in the duct pipe.

SUMMARY OF THE INVENTION

In the aforementioned fluid heater for heating a fluid, an inner circumferential surface of the helical duct pipe is ground. When a surface roughness of the inner circumferential surface is small, i.e., when the inner circumferential surface has nearly no irregularity or no irregularity, a flow of the fluid flowing through the duct pipe is not a turbulent flow but a laminar flow. In this case, a velocity of the fluid flowing through a central part of the duct pipe and a velocity of the fluid flowing near to the inner circumferential surface of the duct pipe differ from each other. Namely, the velocity of the fluid flowing through the central part of the duct pipe is greater than the velocity of the fluid flowing near to the inner circumferential surface of the duct pipe. In addition, a heating degree with respect to the fluid flowing near to the inner circumferential surface of the duct pipe is greater than a heating degree with respect to the fluid flowing through the central part of the duct pipe. Thus, when the flow of the fluid flowing through the duct pipe is not a turbulent flow but a laminar flow, there may be a problem in that the fluid flowing through the duct pipe cannot be uniformly heated.

Further, when the surface roughness of the inner circumferential surface of the duct pipe is small, a surface area of the inner circumferential surface of the duct pipe to be in contact with the fluid flowing through the duct pipe is small. Thus, a transmission area of heat from an outside heat source lamp to the fluid in the duct pipe is small, whereby there may be a problem in that a heat transmission efficiency to the fluid flowing through the duct pipe is impaired.

On the other hand, a case where the inner circumferential surface of the duct pipe is not ground so that the surface roughness of the inner circumferential surface of the duct pipe is large has the following problem. Namely, when a fluid is made to flow through the duct pipe for a long time, dusts are likely to remain on the inner circumferential surface of the duct pipe. The dusts adhering to the inner circumferential surface of the duct pipe are difficult to be washed out.

The present invention has been made in view of the above circumstances. The object of the present invention is to provide a fluid heater and a manufacturing method thereof as described below. That is, due to the provision of one or more fillers inside a duct pipe, a flow of the fluid flowing through the duct pipe becomes, not a laminar flow, but a turbulence flow. Thus, a velocity of the fluid flowing through the duct pipe can be made substantially uniform, whereby the fluid can be heated substantially uniformly. Moreover, due to the filler(s) provided inside the duct pipe, a surface area of a heating portion to be in contact with the fluid flowing through the duct pipe can be increased, whereby a heat transmission efficiency to the fluid flowing through the duct pipe can be improved.

Further, the object of the present invention is to provide a substrate processing apparatus including the aforementioned fluid heater, and a substrate processing method.

The present invention provides a fluid heater configured to heat a fluid, comprising: a duct pipe through which a fluid to be heated flows; a heating part configured to heat the duct pipe; and one or more fillers provided inside the duct pipe.

According to such a fluid heater, one or more fillers is/are provided in the duct pipe through which a fluid formed of a liquid or a gas to be heated flows. Thus, the flow of the fluid flowing through the duct pipe becomes, not a laminar flow, but a turbulence flow, whereby a speed of the fluid flowing through the duct pipe can be made substantially uniform. Therefore, the fluid can be heated substantially uniformly in the duct pipe. Further, due to the provision of the filler(s) inside the duct pipe, a surface area of a heating portion to be in contact with the fluid flowing through the duct pipe can be increased, whereby a heat transmission efficiency to the fluid flowing through the duct pipe can be improved.

In the fluid heater of the present invention, it is preferable that the filler has a heat conductivity. At this time, it is preferable that the filler is made of metal, silicon, ceramics, or a mixture thereof.

In the fluid heater of the present invention, it is preferable that the filler is coated with a fluorocarbon resin. At this time, it is preferable that the filler is fixed on an inner wall of the duct pipe by the fluorocarbon resin.

In the fluid heater of the present invention, it is preferable that the shape of the filler is spherical, columnar or cylindrical. In addition, it is preferable that the filler is formed of a solid or hollow member. In addition, it is preferable that the filler is formed of a fibrous or meshed member.

In the fluid heater of the present invention, it is preferable that the duct pipe is formed of a helical member.

In the fluid heater of the present invention, it is preferable that the heating part is formed of a lamp heater. Alternatively, the heating part may be formed of an induction heater. Alternatively, the heating part may be formed of a resistance heater.

The present invention is a method of manufacturing a fluid heater configured to heat a fluid, the method comprising: preparing a substantially linear duct pipe; filling one or more fillers into the duct pipe; deforming the duct pipe filled with the one or more fillers into a helical shape; and locating a heating part configured to heat the duct pipe.

According to such a manufacturing method of a fluid heater, there can be manufactured a fluid heater in which a duct pipe has a helical shape, and a filler inside the duct pipe also has a helical shape.

In the manufacturing method of a fluid heater of the present invention, it is preferable that after the filler has been filled into the duct pipe, the filler is coated with a fluorocarbon resin. At this time, it is preferable that the coating of the filler with the fluorocarbon resin is performed after the duct pipe has been deformed into a helical shape. In this case, it is preferable that the inside of the duct pipe is cleaned by a chemical liquid, after the duct pipe has been deformed into a helical shape and before the filler is coated with a fluorocarbon resin. Herein, it is preferable that the chemical liquid is an acid chemical liquid.

In the manufacturing method of a fluid heater of the present invention, it is preferable that the shape of the filler is substantially linear, and that when the duct pipe is deformed into a helical shape, the filler filled in the duct pipe is also deformed into a helical shape.

The present invention is a substrate processing apparatus configured to process a substrate, comprising: a supply source configured to supply a liquid of a volatile organic solvent; the fluid heater according to [1], the fluid heater being configured to heat the liquid of the organic solvent supplied from the supply source so as to generate a steam of the organic solvent; and a chamber configured to accommodate a substrate and to dry the substrate accommodated therein, to which the steam of the organic solvent generated by the fluid heater is supplied.

According to such a substrate processing apparatus, a heat transmission efficiency and a uniformity in heating the fluid flowing through the duct pipe of the fluid heater can be enhanced. Thus, the liquid of the organic solvent can be reliably evaporated to generate the steam of the organic solvent, and the steam of the organic solvent can be reliably supplied to the chamber.

The present invention is a substrate processing method for drying a substrate, comprising: preheating the filler in the fluid heater according to [1], before a substrate is accommodated into a chamber; supplying a liquid of a volatile organic solvent into the fluid heater whose filler has been previously heated, and heating the liquid of the organic solvent by the fluid heater so as to generate a steam of the organic solvent; and drying the substrate by supplying the steam of the organic solvent into the chamber accommodating the substrate.

According to such a substrate processing method, while the substrate is being cleaned, the filler of the fluid heater is preheated. After that, the liquid of the organic solvent is supplied to the fluid heater whose fillers have been previously heated, so that the fluid heater heats the liquid of the organic solvent to generate the steam of the organic solvent. Then, the substrate is accommodated into the chamber, and the steam of the organic solvent is supplied, whereby the substrate can be dried. In this manner, by preheating the fillers in the fluid heater, while the substrate is being subjected to a process (e.g., cleaning process) other than the drying process, the steam of the organic solvent can be quickly generated, whereby the substrate can be more quickly dried.

DETAILED DESCRIPTION. OF THE INVENTION

Figure 1:
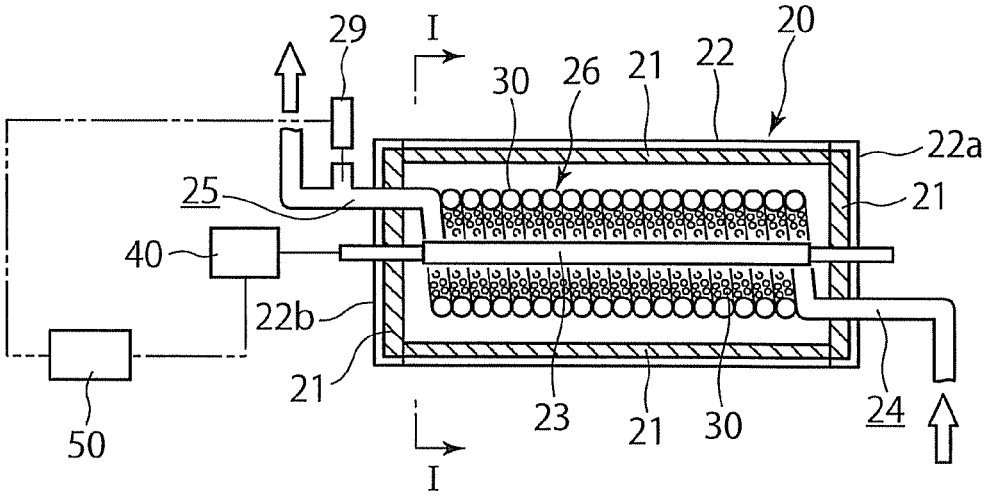
FIG. 1 is a structural view showing a schematic structure of a fluid heater in one embodiment of the present invention.
Figure 2:
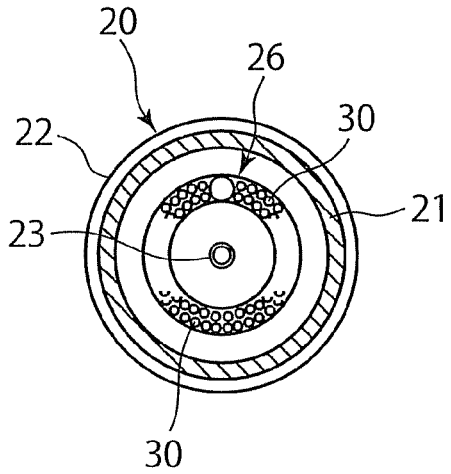
FIG. 2 is a sectional view taken along the line I-I of the fluid heater shown in FIG. 1.
Figure 3:
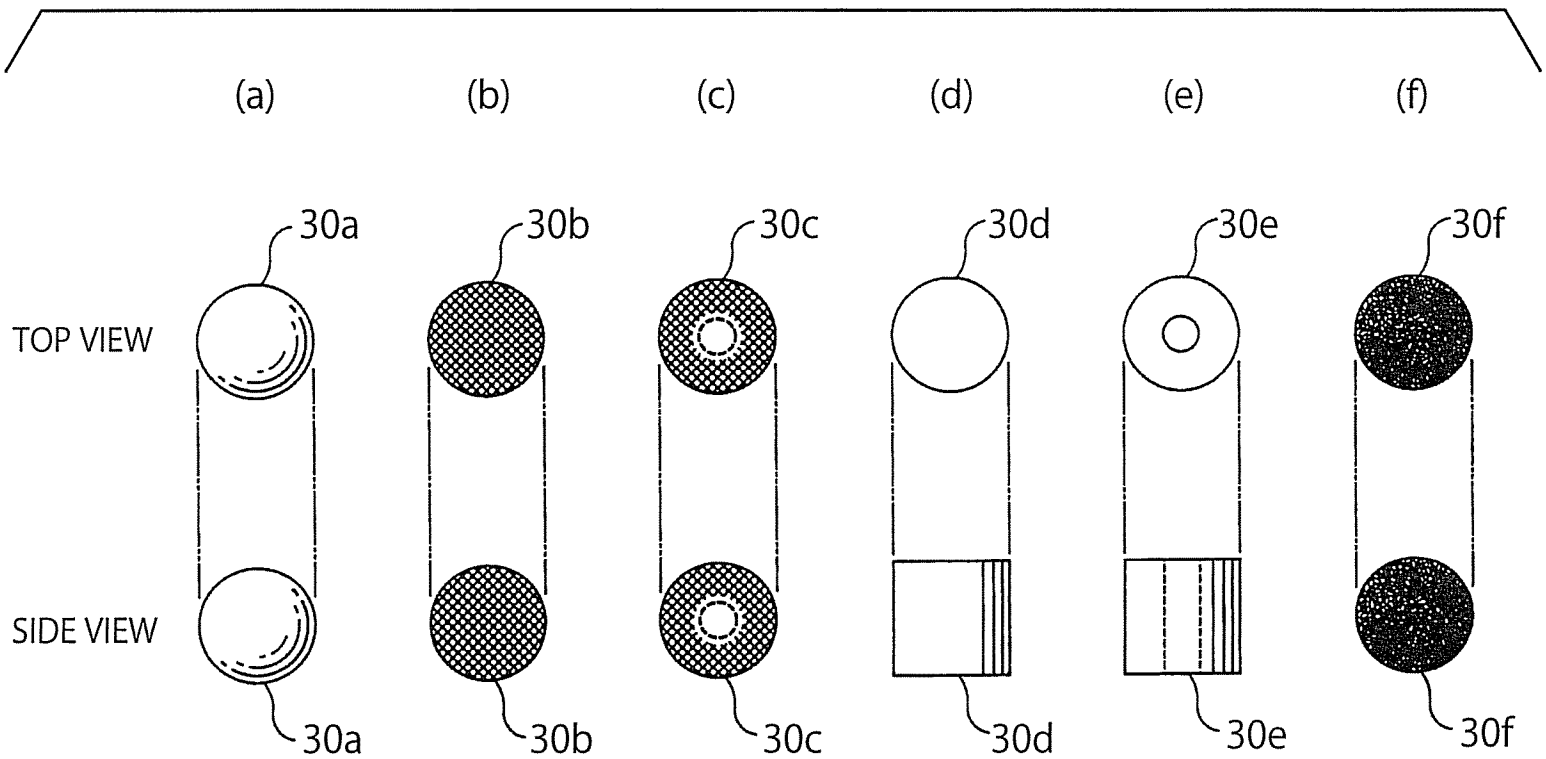
FIG. 3 is an illustrational view showing a structure of a filler provided inside a duct pipe of the fluid heater shown in FIGS. 1 and 2.
Figure 4:
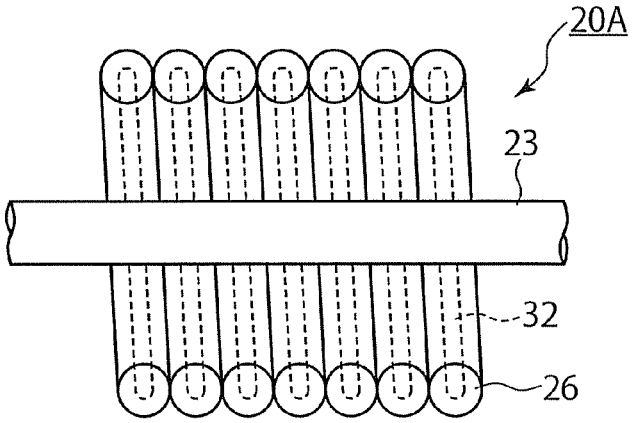
FIG. 4 is an illustrational view showing another structure of the filler provided inside the duct pipe of the fluid heater shown in FIGS. 1 and 2.
Figure 5:
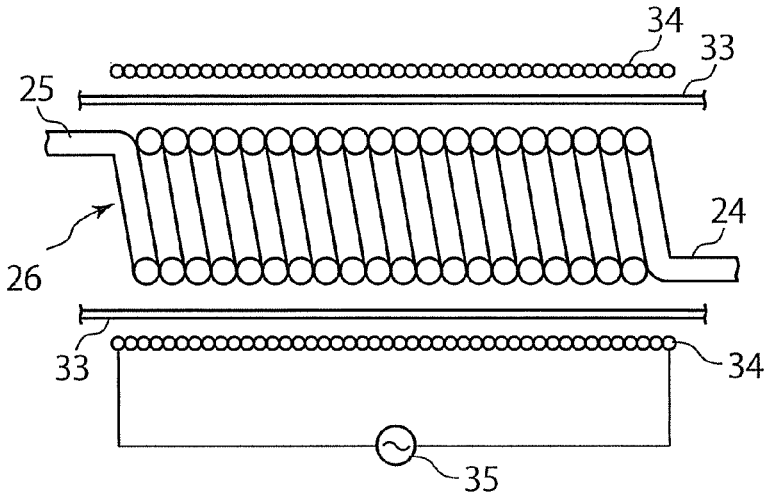
FIG. 5 is a structural view showing another schematic structure of a heating part of the fluid heater in this embodiment.
Figure 6:
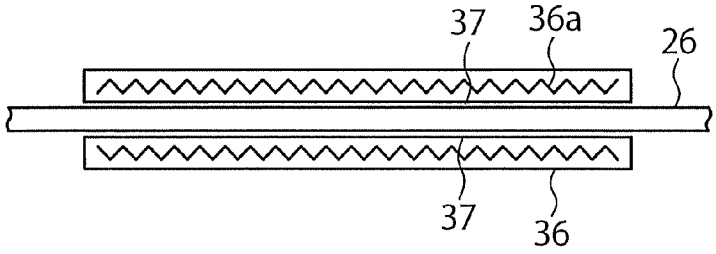
FIG. 6 is a structural view showing still another schematic structure of the heating part of the fluid heater in this embodiment.

An embodiment of the present invention will be described herebelow with reference to the drawings. A fluid heater in this embodiment is firstly described in detail. FIGS. 1 to 6 are views showing the fluid heater in this embodiment. FIG. 1 is a structural view showing a schematic structure of the fluid heater in this embodiment. FIG. 2 is a sectional view taken along the line I-I of the fluid heater shown in FIG. 1. FIG. 3 is an illustrational view showing a structure of a filler provided inside a duct pipe of the fluid heater shown in FIGS. 1 and 2. FIG. 4 is an illustrational view showing another structure of the filler provided inside the duct pipe of the fluid heater shown in FIGS. 1 and 2. FIG. 5 is a structural view showing another schematic structure of a heating part of the fluid heater in this embodiment. FIG. 6 is a structural view showing still another schematic structure of the heating part of the fluid heater in this embodiment.

The fluid heater 20 in this embodiment is configured to heat a fluid formed of a liquid or a gas. The fluid heater 20 includes: a cylindrical container 22; a duct pipe 26 provided inside the cylindrical container 22, the duct pipe 26 being formed of, e.g., a stainless pipe through which a fluid to be heated flows; a halogen lamp heater (heating part) 23 configured to heat the duct pipe 26; and a number of fillers 30 provided inside the duct pipe 26. Herebelow, details of the respective structural elements of the fluid heater 20 are described.

As shown in FIGS. 1 and 2, the halogen lamp heater 23 is extended substantially linearly in a central part of the cylindrical container 22 along a longitudinal direction (right and left direction in FIG. 1) of the cylindrical container 22. The duct pipe 26 is disposed to surround the halogen lamp heater 23. The duct pipe 26 has a helical shape whose center substantially corresponds to the center of the halogen lamp heater 23. As described above, the duct pipe 26 is formed of a stainless pipe, for example.

A heat insulation member 21 is attached to an inner circumferential surface of the cylindrical container 22. Both opening ends of the cylindrical container 22 are respectively closed by end members 22*a* and 22*b* to which the heat insulation members 21 are fixed.

As shown in FIG. 1, one end of the duct pipe 26 passes through the one end member 22*a* of the cylindrical container 22 so as to define a fluid inlet 24, and the other end thereof passes through the other end member 22*b* of the cylindrical container 22 so as to define a fluid outlet 25. In this case, the helical duct pipe 26 and the halogen lamp heater 23 may be arranged adjacent to each other, to a degree that prevents leakage of radiation light from the halogen lamp heater 23. Alternatively, the helical duct pipe 26 and the halogen lamp heater 23 may be arranged in contact with each other.

Disposed near to the outlet 25 of the duct pipe 26 is a temperature sensor 29 configured to detect a temperature of the fluid which has been heated by the halogen lamp heater 23 and outflows from the outlet 25. In addition, connected to the halogen lamp heater 23 is a current adjuster 40 configured to adjust a heating value of the halogen lamp heater 23. As shown in FIG. 1, the respective temperature sensor 29 and the current adjustor 40 are electrically connected to a control part 50. Thus, a temperature detected by the temperature sensor 29 is transmitted to the control part 50, and a control signal from the control part 50 is transmitted to the current adjuster 40, so that the current adjuster 40 is controlled such that the heated fluid is maintained at a predetermined temperature.

As shown in FIGS. 1 and 2, a large number of fillers 30 are filled inside the duct pipe 26. Each filler 30 is made of a heat-conductive material, precisely, metal such as copper, gold or silver, silicon, ceramics, or a mixture thereof, for example.

The shape of each filler 30 is described with reference to FIG. 3. FIGS. 3(*a*) to 3(*f*) are top views and side views showing various shapes of the filler 30.

As shown in FIG. 3(*a*), the filler 30 may have a solid spherical shape. As shown in FIG. 3(*b*), the filler 30 may have a meshed spherical shape. In the filler 30 shown in FIG. 3(*b*), the mesh is embedded in the sphere. Alternatively, as shown in FIG. 3(*c*), the filler 30 may have a meshed spherical shape having therein a space. Alternatively, as shown in FIG. 3(*d*), the filler 30 may have a solid columnar shape. Alternatively, as shown in FIG. 3(*e*), the filler 30 may have a cylindrical shape. Alternatively, as shown in FIG. 3(*f*), the filler 30 may be formed of a fibrous member. The shape of the filler 30 is not limited to those shown in FIGS. 3(*a*) to 3(*f*), and may have a shape other than those shown in FIGS. 3(*a*) to 3(*f*).

As shown in FIG. 4, in place of the many fillers filled inside the duct pipe 26, a single helical filler 32 may be provided inside the duct pipe 26. A manufacturing method of a fluid heater 20A including the helical duct pipe 26 in which the helical filler 32 is disposed inside, which is shown in FIG. 4, is described below.

When the fluid heater 20A having the structure shown in FIG. 4 is manufactured, a substantially linear duct pipe 26 is prepared at first. Then, the substantially linear filler 32 is filled into the duct pipe 26 along the same. Then, the duct pipe 26 filled with the filler 32 is deformed into a helical shape. At this time, when the substantially linear duct pipe 26 is deformed into a helical shape, the filler 32 filled inside the duct pipe 26 is deformed into a helical shape. Finally, the substantially linearly extending halogen lamp heater 23 is located inside the helical duct pipe 26 such that the halogen lamp heater 23 is surrounded by the helical duct pipe 26. In this manner, the fluid heater 20A having the structure shown in FIG. 4 can be obtained.

The fillers 30 shown in FIGS. 1 to 3 and the filler 32 shown in FIG. 4 are preferably coated with a fluorocarbon resin. When each filler 30 or the filler 32 is made of a metal material such as copper, gold or silver, the following advantage can be obtained by coating the filler 30 with a fluorocarbon resin. Namely, even when the filler 30 collides with an inner wall of the duct pipe 26, metal particles are prevented from generating from the filler 30. Further, the filler 30 is preferably fixed on the inner wall of the duct pipe 26 by the fluorocarbon resin. This can prevent the filler 30 from moving in the duct pipe 26.

Herebelow, a method of coating the fillers 30 shown in FIGS. 1 to 3 or the filler 32 shown in FIG. 4 with a fluorocarbon resin is described with reference to JP53-132035A. At first, the fillers 30 or the filler 32 are filled into the duct pipe 26. Then, grains of a fluorocarbon resin are fluidized while the grains are electrically charged. Then, the fluidized fluorocarbon resin grains are sent into the duct pipe 26, so that the fluorocarbon resin grains electrostatically adsorb on the surface of each filler 30 or the filler 32. Alternatively, the following electrostatic adsorption of fluorocarbon resin grains on the surface of the filler 30 may be possible. Namely, fluorocarbon resin grains together with a gas such as air are jetted from a jetting nozzle, so that the fluorocarbon resin grains are electrically charged at the jetting nozzle portion. The fluorocarbon resin grains jetted from the jetting nozzle are sent into the duct pipe 26, so that the fluorocarbon resin grains electrostatically adsorb on the surface of the filler 30.

As further another method of coating the fillers 30 or the filler 32 with a fluorocarbon resin, the following method is possible. Namely, each filler 30 or the filler 32 is preheated at a temperature higher than a molten temperature of a fluorocarbon resin, and grains of a fluorocarbon resin are sprayed onto the preheated filler 30 so that the fluorocarbon resin grains adsorb thereon. As still further another method, a method of coating the filler 30 with a fluorocarbon resin by a fluidized-bed coating is possible.

As grains of a fluorocarbon resin used in the above coating, it is preferable to use grains having a grain diameter between, e.g., 2 and 400 μm and a bulk density between, e.g., 0.1 and 1.2 g/cm$^3$, with a grain size distribution of the grains being relatively narrow. In addition, the grains of a fluorocarbon resin preferably have a shape relatively resembling a spherical shape.

As still another method of coating each filler 30 or the filler 32 with a fluorocarbon resin, as shown in JP2007-179047A, a method of coating an outer circumferential surface of the filler 30 with a film of a fluorocarbon resin by melting or baking is possible.

In the manufacture of the fluid heater 20A having the structure shown in FIG. 4, when the filler 32 is coated with a fluorocarbon resin, the duct pipe 26 filled with the filler 32, which is not yet coated, is deformed into a helical shape, and thereafter, the inside of the duct pipe 26 is cleaned by means of an acid chemical liquid such as sulfuric acid. This can remove dusts such as metal particles which have been generated from the duct pipe 26 and the filler 32 when the duct pipe 26 is deformed into a helical shape, and a surface condition of the inner wall of the duct pipe 26 can be settled.

After the inside of the duct pipe 26 has been cleaned by the acid chemical liquid, the filler 32 in the duct pie 26 is coated with a fluorocarbon resin by the above-described method. At this time, the filler 32 is fixed onto the inner wall of the duct pipe 26 by the fluorocarbon resin. Finally, the substantially linearly extending halogen lamp heater 23 is located inside the helical duct pipe 26 such that the halogen lamp heater 23 is surrounded by the helical duct pipe 26.

In the fluid heater in this embodiment, the heating part for heating the duct pipe 26 is not limited to the halogen lamp heater 23 shown in FIGS. 1 and 2. As shown in FIG. 5, for example, an induction heater may be used as an alternative heating part. More specifically, a stainless pipe is used as the helical duct pipe 26, and a coil 34 is arranged around the helical duct pipe 26 through an insulation member 33. By applying a radiofrequency to the coil 34 by a radiofrequency power source 35, an induced electromotive force is generated in a direction where a magnetic field of the coil 34 is blocked with respect to the helical duct pipe 26 (i.e., left direction in FIG. 5). Thus, since an induced current flows through the duct pipe 26, the duct pipe 26 can be heated by the Joule heat. At this time, when the fillers 30 are made of metal, the induced current flows through the fillers 30, whereby the fillers 30 are heated by the Joule heat. With the use of such an induced heater composed of the coil 34 and the radiofrequency power source 35, the duct pipe 26 can be heated, as well as the fillers 30 can be heated if the fillers 30 are made of metal.

As further alternative example of the heating part for heating the duct pipe 26, a resistance heater as shown in FIG. 6, for example, may be used. More specifically, a resistance heater 36, such as a strip-like ribbon heater or a rubber heater, or a tubular ceramic heater, is wound around the substantially linearly extending duct pipe 26. Such a resistance heater 36 is configured to generate a heat by a current flowing through a heating conductor 36*a* such as a nichrome wire. Although the resistance heater 36 is wound around the duct pipe 26, a gap may be defined between the duct pipe 26 and the resistance heater 36. Thus, a heat-conductive member 37 may be arranged in the gap.

As described above, according to the fluid heater 20 in this embodiment, one or more fillers 30 is/are provided inside the duct pipe 26 through which a fluid formed of a liquid or a gas to be heated flows. Thus, the flow of the fluid flowing through the duct pipe 26 becomes, not a laminar flow, but a turbulence flow, whereby a velocity of the fluid flowing through the duct pie 26 can be made substantially uniform. Therefore, the fluid can be heated substantially uniformly in the duct pipe 26. Moreover, due to the provision of the filler 30 inside the duct pipe 26, a surface area of a heating portion to be in contact with the fluid flowing through the duct pipe 26 can be increased. Thus, a heat transmission efficiency to the fluid flowing through the duct pipe 26 can be improved.

Further, since the filler 30 has a heat conductivity, the filler 30 is sufficiently heated when the duct pipe 26 is heated by the halogen lamp heater 23, so that the heat of the filler 30 is directly transmitted to the fluid flowing through the duct pipe 26. Thus, a heating degree with respect to the fluid flowing through the duct pipe 26 can be more increased. The filler 30 having a heat conductivity may be made of, e.g., metal such as copper, gold or silver, silicon, ceramics, or a mixture thereof. However, not limited to these examples, another member having a heat conductivity may be used.

In addition, since the filler 30 is coated with a fluorocarbon resin, the following advantage can be obtained when the filler 30 is made of a metal material such as copper, gold or silver. Namely, even when the filler 30 collides with an inner wall of the duct pipe 26, metal particles are prevented from generating from the filler 30. Further, when the filler 30 is fixed on the inner wall of the duct pipe 26 by the fluorocarbon resin, the filler 30 can be prevented from moving in the duct pipe 26.

In addition, in the present invention, the material of the filler 30 is not limited to a heat-conductive material. The filler 30 may be made of a styrene foam or a resin.

In addition, by forming the filler 30 to have a spherical shape, a columnar shape or a cylindrical shape, a surface area of the filler 30 to be in contact with the fluid flowing through the duct pipe 26 can be increased, so that a surface area of a heating portion to be in contact with the fluid flowing through the duct pipe 26 can be also increased. Similarly, when the filler 30 is made of a fibrous material or a meshed material, a surface of the filler 30 to be in contact with the fluid flowing through the duct pipe 26 can be increased, so that a surface area of a heating portion to be in contact with the fluid flowing through the duct pipe 26 can also be increased. However, the shape of the filler 30 is not limited to the above examples.

In addition, since the duct pipe 26 has a helical shape, a space occupied by the duct pipe 26 can be made smaller, as compared when the duct pipe 26 has a substantially linear shape. Thus, the size of the fluid heater 20 can be reduced.

Figure 7:
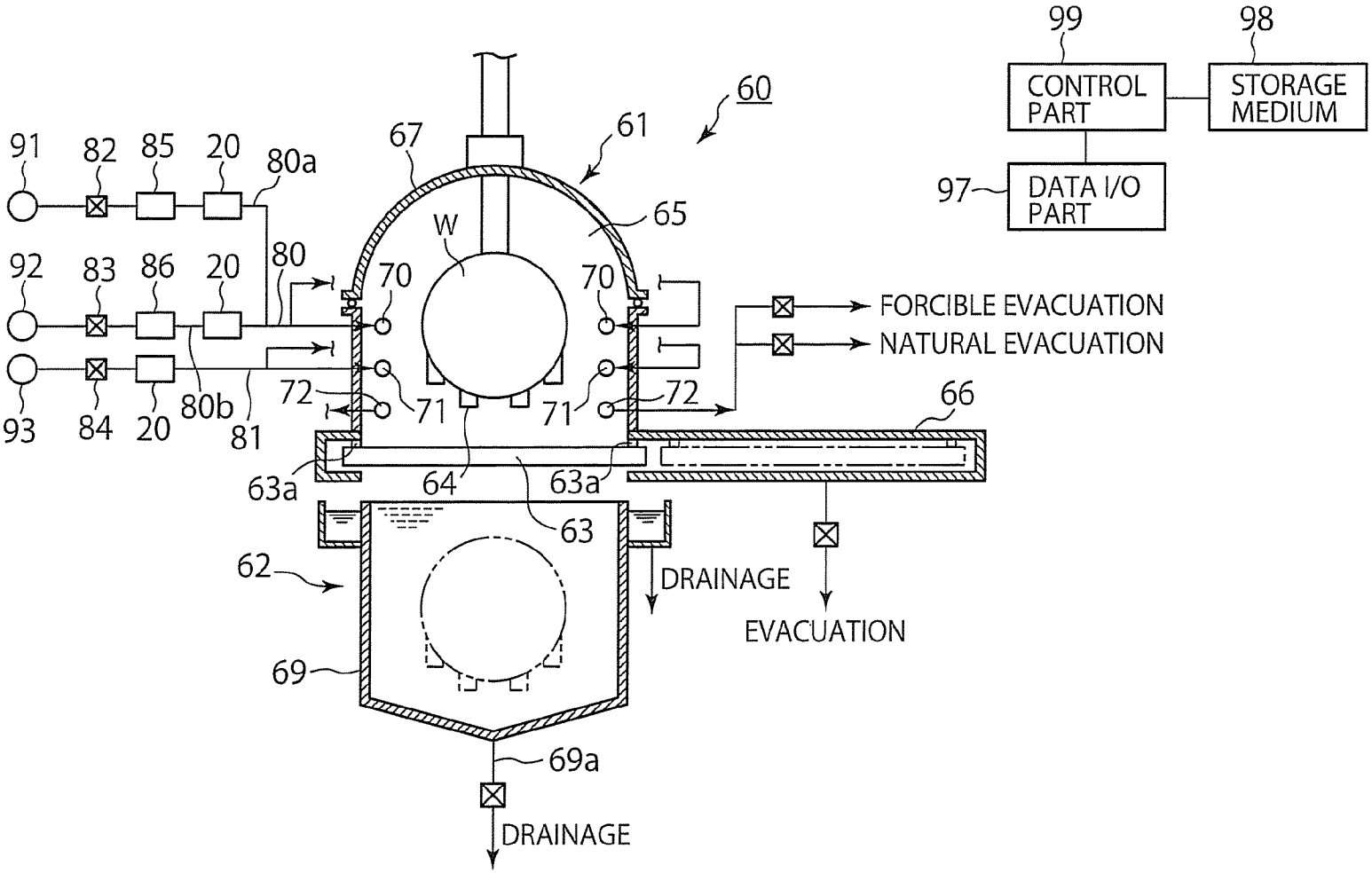
FIG. 7 is a schematic view showing a schematic structure of a substrate processing apparatus in one embodiment of the present invention.

Next, a substrate processing apparatus 60 including the fluid heater 20 shown in FIG. 1 is described with reference to FIG. 7. FIG. 7 is a schematic view showing a schematic structure of the substrate processing apparatus 60 in one embodiment of the present invention.

The substrate processing apparatus 60 shown in FIG. 7 includes: a liquid processing part 62 configured to perform a chemical liquid process and a cleaning process for a semiconductor wafer W (hereinafter also referred to simply as "wafer"); and a drying part 61 disposed above the liquid processing part 62, the drying part 61 being configured to dry a wafer W which has been cleaned by the liquid processing part 62. The liquid processing part 62 is configured to process a wafer W by means of a predetermined chemical liquid (e.g., dilute hydrofluoric acid (DHF), ammonium/hydrogen peroxide water (APF), and sulfuric acid/hydrogen peroxide mixture (SPM)), and then to clean the wafer W by means of a deionized water (DIW). In addition, the substrate processing apparatus 60 includes a wafer guide 64 capable of holding a plurality of (e.g., fifty) wafers W. The wafer guide 64 can be moved (elevated and lowered) between the liquid processing part 62 and the drying part 61. A fan filter unit (FFU, not shown) is arranged above the substrate processing apparatus 60. A clean air is supplied as a down flow by the fan filter unit to the substrate processing apparatus 60.

As shown in FIG. 7, the liquid processing part 62 has a storage tank 69 capable of storing a chemical liquid and a deionized water. A chemical liquid and a deionized water are alternately stored in the storage tank 69. By immersing a wafer W into the chemical liquid and the deionized water, the wafer W is subjected to a chemical liquid process and a cleaning process.

The drying part 61 is provided with a chamber 65 for accommodating a wafer W, and a chamber wall 67 defining therein the chamber 65.

An atmosphere near to the storage tank 69 disposed in the liquid processing part 62, and an atmosphere in the chamber 65 disposed in the drying part 61 can be separated from each other or communicated with each other by a shutter 63 that is slidably disposed between the storage tank 69 and the chamber 65. When the liquid process is performed in the storage tank 69 of the liquid processing part 62, and when a wafer W is moved by the wafer guide 64 between the storage tank 69 and the chamber 65, the shutter 63 is received in a shutter box 66, so that the atmosphere near to the storage tank 69 and the atmosphere of the chamber 65 are communicated with each other. On the other hand, when the shutter 63 is located directly below the chamber 65, a seal ring 63*a* arranged on an upper surface of the shutter 63 comes into contact with a lower end of the chamber wall 67, so that a lower opening of the chamber 65 is hermetically closed.

Disposed inside the chamber 65 is a fluid nozzle 70 configured to supply a mixture of a water steam and a steam of IPA (isopropyl alcohol), or to separately supply a water steam and a steam of IPA, into the chamber 65. A pipe 80 is connected to the fluid nozzle 70. The pipe 80 is diverged into a pipes 80*a* and 80*b* which are connected to a deionized-water supply source 91 and an IPA supply source 92, respectively. By opening an opening and closing valve 82 disposed on the pipe 80*a* and by operating a flow-rate control valve 85, a deionized water is supplied at a predetermined flow rate to the fluid heater 20, and the deionized water is heated by the fluid heater 20 so that a water steam is generated. Similarly, by opening an opening and closing valve 83 disposed on the pipe 80*b* and by operating a flow-rate control valve 86, a liquid of IPA is supplied at a predetermined flow rate to the fluid heater 20, and the liquid of IPA is heated by the fluid heater 20 so that a steam of IPA is generated. The water steam and the IPA steam are separately jetted into the chamber 65 from the fluid nozzle 70. Alternatively, the water steam and the IPA steam are mixed in the pipe 80, and the mixture is jetted into the chamber 65 from the fluid nozzle 70.

Inside the chamber 65, there is provided an $N_2$ gas nozzle 71 for jetting $N_2$ gas (nitrogen gas) heated at a predetermined temperature into the chamber 65. As shown in FIG. 7, by opening an opening and closing valve 84, $N_2$ gas at a room temperature is adapted to be supplied from an $N_2$ gas supply source 93 to the fluid heater 20. The $N_2$ gas can be heated to a predetermined temperature by the fluid heater 20, and the heated $N_2$ gas can be jetted from the $N_2$ gas nozzle 71 into the chamber 65 through an $N_2$ gas supply line 81.

In addition, inside the chamber 65, there is provided an exhaust nozzle 72 for discharging an atmospheric gas in the chamber 65. The exhaust nozzle 72 has a natural exhaust line for naturally exhausting the chamber 65, and a forcible exhaust line for forcibly exhausting the chamber 65.

The substrate processing apparatus 60 is equipped with a control part 99 configured to control the aforementioned respective structural elements. The control part 99 is connected to the respective structural elements of the substrate processing apparatus 60, to thereby control operations of the respective structural elements (specifically, for example, elevating and lowering of the lid part of the chamber wall 67, elevating and lowering of the wafer guide 64, sliding of the shutter 63, and opening and closing of the respective valves 82, 83, 84, 85 and 86). In this embodiment, connected to the control part 99 is a keyboard through which a step manager can input a command for managing the substrate processing apparatus 60, and a data I/O part 97 formed of a display panel visually displaying operation conditions of the substrate processing apparatus 60. Further, connected to the control part 99 is a storage medium 98 storing a control program for realizing various processes to be performed by the substrate processing apparatus 60 under the control of the control part 99, and programs (i.e., recipes) for causing the respective structural elements of the substrate processing apparatus 60 to perform processes depending on process conditions. The storage medium 98 may be formed of a memory such as a ROM or a RAM, a hard disc, and a disc-shaped storage medium such as a CD-ROM or a DVD-ROM, or another known storage medium.

According to need, a given recipe is called from the storage medium 98 by an instruction from the data I/O part 97 so as to be executed by the control part 99. Then, a desired process is performed by the substrate processing apparatus 60 under the control of the control part 99.

Next, a method of processing a wafer W with the use of the aforementioned substrate processing apparatus 60 is described. The below-described series of chemical liquid process, the cleaning process and the drying process are performed by the respective structural elements of the substrate processing apparatus 60 which are controlled by the control part 99 in accordance with the programs (recipes) stored in the storage medium 98.

At first, the storage tank 69 of the liquid processing part 62 and the chamber 65 of the drying part 61 are separated from each other by the shutter 63. $N_2$ gas is filled into the chamber 65, and an inside pressure of the chamber 65 is made equal to an atmospheric pressure. On the other hand, a predetermined chemical liquid is stored to the storage tank 69. Under this state, the wafer guide 64 is positioned in the chamber 65 of the drying part 61.

Then, the supply of the $N_2$ gas into the chamber 65 is stopped, and fifty wafers W are transferred from an outside substrate transfer apparatus (not shown) to the wafer guide 64. Thereafter, while the air is forcibly discharged from the exhaust nozzle 72, the shutter 63 is slid such that the storage tank 69 of the liquid processing part 62 and the chamber 65 of the drying part 61 are communicated with each other.

Following thereto, the wafer guide 64 is lowered, so that the wafers W held by the wafer guide 63 are immersed into the chemical liquid stored in the storage tank 69 for a predetermined period of time. After the chemical liquid process for the wafers W has been finished, a deionized water is supplied to the storage tank 69 while the wafers W remain in the storage tank 69, so as to substitute the chemical liquid in the storage tank 69 with the deionized water, whereby the wafers W are cleaned. Alternatively, the substitution of the chemical liquid in the storage tank 69 with the deionized water may be performed as follows. Namely, the chemical liquid is discharged from the storage tank 69 through a drain pipe 69*a*, and thereafter a deionized water is supplied to the storage tank 69.

While the chemical liquid process and the cleaning process for the wafers W are being performed, the heat-conductive fillers 30 in each fluid heater 20 are preheated by the halogen lamp heater 23. To be specific, by preheating the duct pipe 26 by means of the halogen lamp heater 23, the duct pipe 26 has a high temperature so that the fillers 30 are heated by the duct pipe 26.

After the chemical liquid process and the cleaning process for the wafers W have been finished, the exhaust of the chamber 65 is performed by the natural exhaust line that is switched from the forcible exhaust line, and $N_2$ gas heated at a predetermined temperature is supplied from the $N_2$ gas nozzle 71 into the chamber 65, so as to maintain the chamber 65 in the heated $N_2$ gas atmosphere. Since the inside of the chamber 65 is warmed up, the chamber wall 67 is also warmed up. Thus, when an IPA steam is supplied into the chamber 65 in the subsequent step, condensation of the IPA steam on the chamber wall 67 can be prevented.

After the heated $N_2$ gas has been supplied into the chamber 65, a water steam is supplied into the chamber 65 by the fluid nozzle 70. Thus, the chamber 65 is filled with the water steam atmosphere. Following thereto, in order that the wafers W are accommodated into the chamber 65, the wafer guide 64 is started to be elevated. Since the wafers W are elevated into the space filled with the water steam, the wafers W are prevented from drying. Thus, at this stage, there is no possibility that a watermark might be formed on the wafers W.

When the wafers W are elevated to reach a position at which the wafers W are accommodated into the chamber 65, the elevation of the wafer guide 64 is stopped, and the shutter 63 is closed to separate the storage tank 69 and the chamber 65 from each other. After the wafers W have been held on predetermined positions in the chamber 65, an IPA steam is started to be supplied into the chamber 65 from the fluid nozzle 70. Thus, the deionized water adhering on the surface of each wafer W is substituted with the IPA. Since the change of a surface tension of the liquid on the surface of the wafer is moderate, non-uniformity in thickness of a liquid film can be prevented, and a balance in the surface tension applied to a projection of a circuit pattern on the wafer W is difficult to be lost. Therefore, falling-down of the pattern can be restrained. In addition, due to the substantially simultaneous drying in the wafer plane, formation of watermarks can be restrained.

By supplying the IPA steam for a predetermined period of time, an IPA liquid film is formed on each wafer W. Then, the supply of the IPA steam into the chamber 65 is stopped, and a drying process for the wafers W is continuously performed. The drying process may be performed according to the following procedure, for example. Namely, $N_2$ gas heated to a predetermined temperature is supplied into the chamber 65 so as to volatilize and evaporate the IPA from the surface of the wafer W, and thereafter $N_2$ gas at a room temperature is supplied into the chamber 65 so as to cool the wafer W to a predetermined temperature.

In this drying process, since the IPA on the surface of the wafer W is uniformly volatilized, a balance in the surface tension applied to the projection of the circuit pattern on the wafer W is difficult to be lost, whereby falling-down of the pattern can be restrained. Further, since the wafer W is dried from the condition where only the IPA exists on the surface of the wafer W, formation of watermarks can be restrained.

After the drying of the wafers W has been finished, the not-shown substrate transfer apparatus approaches the wafer guide 64 from outside, and unloads the wafers W from the substrate processing apparatus 60. In this manner, the series of the processes for the wafers W in the substrate processing apparatus 60 are finished.

According to the substrate processing method, before the wafer W are accommodated into the chamber 65, the fillers 30 in the fluid heater 20 are preheated while the chemical liquid process and the cleaning process of the wafers W are being performed. After that, a liquid of IPA is supplied to the fluid heater 20 whose fillers 30 have been previously heated, so that the fluid heater 20 heats the liquid of IPA to generate an IPA steam. Then, by supplying the IPA steam into the chamber 65 accommodating therein the wafers W, the wafers W are dried. Namely, the fillers 30 of the fluid heater 20 are preheated, while the wafers W are being subjected to a process (e.g., chemical liquid process and cleaning process) other than the drying process. Thus, the IPA steam can be quickly generated, whereby the wafers W can be more quickly dried.

The invention claimed is:

1. A fluid heater configured to heat an organic solvent, comprising:

a duct pipe, wound in a form of a helix and having therein a fluid passage through which the organic solvent to be heated flows;

a heater disposed, outside the duct pipe, in a space surrounded by the helix to heat the duct pipe; and one or more fillers provided inside the duct pipe, wherein the one or more fillers are coated with a fluorocarbon resin and are fixed on an inner wall surface of the duct pipe by the fluorocarbon resin.

2. The fluid heater according to claim 1, wherein the filler has a heat conductivity.

3. The fluid heater according to claim 2, wherein the filler is made of metal, silicon, ceramics, or a mixture thereof.

4. The fluid heater according to claim 1, wherein the shape of the filler is spherical, columnar or cylindrical.

5. The fluid heater according to claim 1, wherein the filler is formed of a solid or hollow member.

6. The fluid heater according to claim 1, wherein the filler is formed of a fibrous or meshed member.

7. The fluid heater according to claim 1, wherein the heating part is formed of a lamp heater.

8. The fluid heater according to claim 1, wherein the lamp heater is formed of a halogen lamp heater.

9. A method of manufacturing a fluid heater configured to heat an organic solvent, the method comprising:

preparing a substantially linear duct pipe;

filling one or more fillers into the duct pipe;

deforming the duct pipe filled with the one or more fillers into a helical shape; and locating a heating part configured to heat the duct pipe such that the heating part is surrounded by the helical duct pipe.

10. The method of manufacturing a fluid heater according to claim 9, wherein after the filler has been filled into the duct pipe, the filler is coated with a fluorocarbon resin.

11. The method of manufacturing a fluid heater according to claim 10, wherein the coating of the filler with the fluorocarbon resin is performed after the duct pipe has been deformed into a helical shape.

12. The method of manufacturing a fluid heater according to claim 11, wherein the inside of the duct pipe is cleaned by a chemical liquid, after the duct pipe has been deformed into a helical shape and before the filler is coated with a fluorocarbon resin.

13. The method of manufacturing a fluid heater according to claim 12, wherein the chemical liquid is an acid chemical liquid.

14. The method of manufacturing a fluid heater according to claim 9, wherein the shape of the filler is substantially linear, and when the duct pipe is deformed into a helical shape, the filler filled in the duct pipe is also deformed into a helical shape.

15. A substrate processing apparatus configured to process a substrate, comprising:

a supply source configured to supply a liquid of a volatile organic solvent;

a fluid heater configured to heat the organic solvent, comprising:

a duct pipe, formed of a helical member, through which the organic solvent to be heated flows;

a heating part, surrounded by the helical duct pipe, configured to heat the duct pipe; and one or more tillers provided inside the duct pipe, the fluid healer being configured to heat the liquid of the organic solvent supplied from the supply source so as to generate a steam of the organic solvent; and a chamber configured to accommodate a substrate and to dry the substrate accommodated therein, to which the steam of the organic solvent generated by the fluid heater is supplied.

16. A substrate processing method for drying a substrate, comprising:

providing a fluid heater configured to heat an organic solvent, comprising:

a duct pipe, formed of a helical member, through which the organic solvent to be heated flows;

a heating part, surrounded by the helical duct pipe, configured to heat the duct pipe; and one or more fillers provided inside the duct pipe, preheating the one or more fillers in the fluid heater, before a substrate is accommodated into a chamber;

supplying a liquid of the organic solvent into the fluid heater whose one or more fillers have been previously heated, and heating the liquid of the organic solvent by the fluid heater so as to generate a steam of the organic solvent; and drying the substrate by supplying the steam of the organic solvent into the chamber accommodating the substrate.

17. A storage medium which stores a program capable of being executed by a control part of the substrate processing apparatus according to claim 15, in which the program is executed so that the control part controls the substrate processing apparatus to execute the substrate processing method, the substrate processing method including:

preheating the one or more fillers in the fluid heater before a substrate is accommodated into a chamber;

supplying the liquid of the volatile organic solvent into the fluid heater whose one or more fillers have been previously heated, and heating the liquid of the organic solvent by the fluid heater so as to generate a steam of the organic solvent; and drying the substrate by supplying the steam of the organic solvent into the chamber accommodating the substrate.

18. The fluid heater according to claim 1, wherein the one or more fillers are disposed in such a manner that a flow of the organic solvent flowing through the duct pipe is disturbed by the one or more fillers so as to become a turbulent flow.

* * * * *